US008677555B1

(12) United States Patent
McCallum

(10) Patent No.: US 8,677,555 B1
(45) Date of Patent: Mar. 25, 2014

(54) SPILL CLEAN-UP SYSTEM AND METHOD

(75) Inventor: Erick McCallum, Arlington, TX (US)

(73) Assignee: Annihilator Cleaning Equipment, LLC, Fort Worth, TX (US)

( * ) Notice: Subject to any disclaimer, the term of this patent is extended or adjusted under 35 U.S.C. 154(b) by 0 days.

(21) Appl. No.: 12/460,745

(22) Filed: Jul. 23, 2009

Related U.S. Application Data

(60) Provisional application No. 61/135,670, filed on Jul. 23, 2008.

(51) Int. Cl.
*E01H 1/08* (2006.01)
*A47L 7/00* (2006.01)

(52) U.S. Cl.
USPC ..... 15/340.1; 15/320; 15/321

(58) Field of Classification Search
USPC ..... 15/302, 320, 321, 340.1
See application file for complete search history.

(56) References Cited

U.S. PATENT DOCUMENTS

| | | | | | |
|---|---|---|---|---|---|
| 4,168,562 | A * | 9/1979 | Maasberg | ..... | 15/320 |
| 4,845,801 | A * | 7/1989 | Milly et al. | ..... | 15/321 |
| 5,165,139 | A * | 11/1992 | Oxman | ..... | 15/321 |
| 5,224,236 | A * | 7/1993 | Sallquist | ..... | 15/321 |
| 5,287,589 | A * | 2/1994 | Hughes | ..... | 15/321 |
| 5,469,597 | A * | 11/1995 | Page | ..... | 15/321 |
| 5,500,976 | A * | 3/1996 | Rohrbacher et al. | ..... | 15/320 |
| 5,979,012 | A * | 11/1999 | Fritz | ..... | 15/321 |
| 6,896,742 | B2 * | 5/2005 | Geyer et al. | ..... | 134/21 |
| 7,735,186 | B1 * | 6/2010 | Vogel | ..... | 15/320 |
| 7,954,201 | B1 * | 6/2011 | Martinez | ..... | 15/340.1 |
| 2003/0041407 | A1 * | 3/2003 | Savage | ..... | 15/321 |

* cited by examiner

*Primary Examiner* — Dung Van Nguyen
(74) *Attorney, Agent, or Firm* — James E. Walton; Damon R. Hickman

(57) ABSTRACT

A mobile cleaning system to be used for cleaning organic liquids from a hard surface includes tanks for storing water, and for storing used, dirty water after cleanup. A water-based cleaner is sprayed onto the spill, which can be, but need not be, done in connection with the cleanup system. The system then sprays heated fresh water under high pressure onto the spill. A high throughput vacuum system removes the hot water and the spill materials concurrently as the hot water is applied to the treated area. The vacuumed liquids are stored in an on-board tank for later disposal.

2 Claims, 2 Drawing Sheets

SPILL CLEAN-UP SYSTEM AND METHOD

CROSS-REFERENCE TO RELATED APPLICATIONS

The present application claims priority from U.S. provisional application No. 61/135,670, filed 23 Jul. 2008, the entirety of which is incorporated by reference hereinto.

BACKGROUND OF THE INVENTION

1. Field of the Invention

The present invention relates generally to environmentally friendly cleaning processes, and more specifically to a system and method for cleaning spills that include liquid organic materials.

2. Description of the Prior Art

The passage of the Federal Clean Water Act dictated that all companies regardless of size are now accountable for the recovery, storage and disposal of waste water in an approved manner. Spills, accidents and industrial cleanups must be contained and disposed of.

An example of such a spill includes oils and fuel spilled at the site of a vehicle accident. When automobiles collide, it is common for liquid organic materials to be spilled onto the street, and these materials would create a driving hazard if they are not cleaned up. Inadequate cleaning of fuel and oil spilled onto a roadway can create dangerous slick regions, particularly in response to future rains.

At the present time, when a spill occurs that includes organic or other materials, such as oil, fuels, and other materials, the cleanup process is too complicated and the results not effective enough. Typically, an oil absorbing material is used to soak up the spill; kitty litter is the preferred material for this, but other, similar materials are regularly used.

The absorbent material is spread over the area, swept and then collected. The process is repeated until the excess liquid is absorbed. Depending on the liquid material involved and the size of the spill, this process can take several days over a relatively small area. The amount of waste by-product is significant and stains are left behind.

Such an approach is slow, and collecting the soiled oil absorbing material can be time consuming. Typically, it is a labor intensive process. In addition, the effectiveness of the clean up leaves much to be desired. The current processes have no ability to reach into the pores of the hard surface and extract the oil or other material trapped beneath the surface. Thus in the case of, for example, an automobile collision, fuel and oil is absorbed in the pores of the concrete at the accident site. Spreading the absorbent material over the surface of the concrete removes only the organic materials that remain on the surface, but leaves much of the organic material that soaks into the concrete. Once the cleanup is complete, the organic material that has soaked in is free to be released onto the upper surface, particularly in response to an event such as rain. This makes the surface of the supposedly cleaned roadway very slick and hazardous.

Spills of oil and other organic chemicals in industrial settings generates similar problems. The initial prior art cleanup techniques do not remove the chemicals from beneath the upper surface of the concrete. This means that the organic chemicals slowly rise to the surface over time, causing possibly unsafe conditions that require follow up cleanup activity.

It would be desirable to provide a cleaning system and method that is both faster and easier to use, and is more effective at cleaning spills that include liquid and other organic materials.

organic chemicals slowly rise to the surface over time, causing possibly unsafe conditions that require follow up cleanup activity.

It would be desirable to provide a cleaning system and method that is both faster and easier to use, and is more effective at cleaning spills that include liquid and other organic materials.

SUMMARY OF THE INVENTION

In accordance with the present invention, a mobile cleaning system to be used for cleaning organic liquids from a hard surface includes tanks for storing water, and for storing used, dirty water after cleanup. A water-based cleaner is sprayed onto the spill, which can be, but need not be, done in connection with the cleanup system. The system then sprays heated fresh water under high pressure onto the spill. A high throughput vacuum system removes the hot water and the spill materials concurrently as the hot water is applied to the treated area. The vacuumed liquids are stored in an on-board tank for later disposal.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
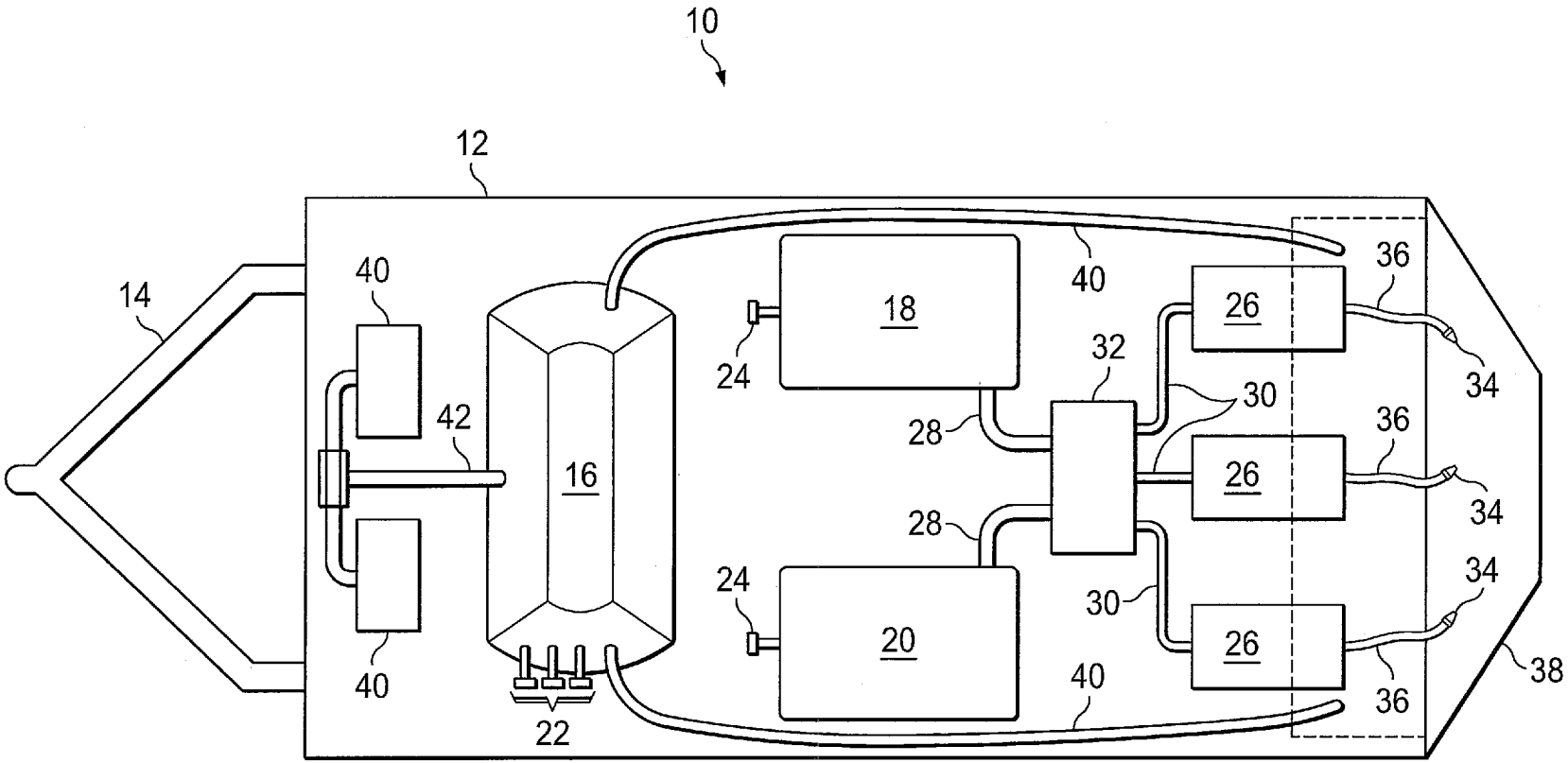
FIG. 1 is a plan diagram of a trailer for use with a preferred embodiment of the present invention.

It will be appreciated by those skilled in the art that the preferred embodiments of the invention, as set forth below, are merely illustrative of the invention, and are not intended to be taken in a limiting sense.

The process of the present invention includes a powerful vacuum capable of establishing and maintaining a negative vacuum in a secure holding tank and the equipment attached to the storage/holding tank. The vacuum system is strong enough to vacuum the cleanup site of all excess liquids and small solids that could contaminate adjacent property and storm sewer systems. Additional storage containers can be utilized to contain excess contaminated water and fluids.

After initial containment and cleanup of the spill is effected, a water soluble cleaner is mixed with super-heated clean water and sprayed evenly over the effected area. Preferably, the water is heated to a temperature below boiling, such as approximately 175 degrees F. This thin layer of water based cleaner causes the organic and other materials in the spill to release from the hard surface, and makes them available to be picked up in the second step. Using heated water allows the water based cleaner to penetrate into the pores of the hard surface to effect a significantly more complete, deep cleaning than heretofore obtained.

In the second step heated, clean water is used under pressure and causes the hydrocarbon molecules to release from the hard surface. Utilizing a containment hood the residue is washed with super-heated clean water under high pulsating pressure and vacuumed all in the same operation. The clean high pressure water cleans deep into the hard surface's pores, and the vacuum dries it all up in one pass. The vacuum sucks all the liquids into the containment tank ready to be transported to the appropriate treatment site.

The various steps of the preferred process will now be discussed in more detail. First, after a spill or accident occurs the area generally must be contained, which defines the treatment area. In the process of the present invention, a retaining dam, if necessary, is built around the area and effectively prevents the spilled material from spreading. If there is solid material inside the contained area, it is swept into piles and loaded into drums or appropriate containers, then loaded onto trucks for disposal. After the area has been swept and cleaned, normally there is some degree of environmentally sensitive liquids remaining within the treatment area.

In the process of the present invention, the liquids remaining pooled on the surface are quickly and efficiently vacuumed into storage tanks especially designed for environmentally hazardous liquids. The vacuum holding tanks are made of a strong and dense material, and are especially constructed to insure that contaminated liquids cannot escape from the tank until the appropriate transport containers are ready. The tanks are held in a constant state of negative pressure, insuring that the contaminated liquid cannot escape from the holding tank except through controlled conditions.

No water or absorbing materials are added to the process at this time; the contaminated liquids are merely vacuumed into the holding tanks. The time frame is cut into minutes instead of days and the additional hazardous waste refuse is eliminated.

As soon as the spill surface is vacuumed relatively dry, a water soluble solution is mixed with a small amount of heated water via mixing wands and sprayed evenly over the contaminated area. The amount of water based cleaner and water sprayed on the surface is enough to wet the surface, but not enough to create runoff. The diluted water soluble solution sits over the area and the water portion of the solution begins to evaporate. Depending upon the viscosity and chemical composition of the spilled material in question, the water soluble based cleaner is allowed to set upon the spoiled surface and begin to chemically and physically release the spilled material from the hard surface to which it has attached.

A suitable water soluble cleaner that can be used for this purpose includes the following materials in approximately the following proportions: water—82%; sodium metasilicate penta (an alkaline builder) 2%; tergitol NP 9 (a water based surfactant)—3%; sodium hydroxide—6%; Mayoquest (a water softener and wetting agent)—1%; glycol ether EB (a water soluble solvent)—5%; T-Multz (a coupling agent)—1%.

After the solvent has set, super-heated clean water is then applied at high pressure to the spoiled area, completing the releasing process. This heated water is simultaneously vacuumed dry and clean by the same vacuum system that removed the original liquid waste. Using water heated to a little less than boiling, such as approximately 175 degrees, and sprayed onto the surface at high pressure allows the surface to be cleaned well below the surface area. The hot water sprayed under high pressure removes organic material from porous materials, such as concrete, for some distance below the upper surface.

With prior art removal techniques, organic liquid materials could be removed from the top surface of concrete and similar materials, but such treatments do not adequately remove the organic liquids from beneath the top surface. Over time, these organic liquids seep back up to the top surface, and can cause problems. For example, if oil spilled onto a roadway after a traffic accident is only cleaned from the upper surface of the roadway, oil from below the surface can migrate back to the surface over time. This can cause a slick region on the roadway for a significant period of time after the accident, in particular after a rain.

With the technique described herein, cleaning is effected below the top surface of the concrete. Thus, in cases such as fuel spills on concrete, the deep cleaning results in a surface that does not become re-contaminated and thus cause unsafe road conditions from the initial spill, which is the case if only the top surface is cleaned.

For small to medium sized spills, a 500 gallon vacuum tank is sufficient to collect everything that is vacuumed up. If the contaminated area is larger than the 500 gallon capacity of the vacuum tank, then extra 500 gallon plastic tanks, preferably encased in wire mesh, are connected to the vacuum holding tank and used to drain it. Once the vacuum tank is emptied the process continues. The surface is returned to its original color and texture. After the vacuuming process is completed, the containing dam is removed and the job is complete.

The total process usually takes less than two hours and the road or affected area is returned to service in a fraction of the time and expense experienced in conventional methods. The amount of contaminated waste is geometrically reduced with no run off except for that generated by the initial spill itself. The cleaner formula is non-toxic and presents no personnel issues that aren't washed away with clean water.

The system is preferably mounted on a truck or trailer to make it portable. As shown in FIG. 1, one preferred embodiment is a trailer on which all of the equipment needed to effect clean up can be mounted. A similar arrangement can be made using a truck, as is described below in connection with FIG. 2. Both designs allow a clean up to be performed by a small clean up crew, in many cases a single person.

As shown in FIG. 1, a trailer mounted cleaning system 10 in accordance with the present invention includes a bed 12 on which equipment is located, and a tow hitch 14 for pulling the trailer in the normal way. This embodiment of a cleaning system includes a single vacuum storage tank 16 having walls thick enough to withstand atmospheric pressure against a vacuum. Clean water storage tanks 18, 20 are used to store and provide clean water used in the cleaning process.

Preferably, vacuum storage tank 16 has a capacity of approximately 500 gallons, but any other size that will be suitable for a particular task may be used. Several valves 22 are provided on the vacuum storage tank 16 so that liquid and small debris can be removed, and the system purged as needed. During use, if the storage tank 16 should become filled, the vacuum can be released and liquid and debris pumped out of the valves 22 into one or more waste storage tanks (not shown) for removal.

Clean water storage tanks may have a capacity of approximately 325 gallons each, although other volumes can be used if desired. Also, while two tanks are shown in the drawing as suitable for use due to weight balancing reasons, one tank, or more than two tanks, can be used if desired. Tanks 18, 20 are also provided with valves 24 by which the tanks can easily be refilled if needed.

Three heater/compressor units 26 are connected to the water storage tanks 18, 20 by an arrangement of pipes (or hoses) 28, 30 and valves 32 that enable water to be supplied to the units 26 on demand. Units 26 heat incoming water to approximately 150-200 degrees F. (slightly below boiling so that steam is not generated) and provide it under a pressure of at least approximately 3,500 psi to washer unit nozzles 34 through high pressure hoses 36. Three high pressure nozzles 34 are shown in the drawing, but any suitable number can be used. These nozzles provide a relatively uniform spray at high pressure down to the surface on which the trailer is rolling, enabling hot water to penetrate beneath the porous surface.

The high pressure spray can be created by directing water at preferably 3,500 lbs/square inch or greater into three bearings, spinning them and creating the super agitation necessary to complete the removal process. Other set-ups that provide a high pressure water spray can also be used. The bearings used to generate the high pressure spray are incorporated into a retractable vacuum hood 38 which is lowered close to the ground, and includes a skirt to prevent water and other material from escaping. Also connected to the vacuum hood 38 are several vacuum lines 40 that are used to retrieve water, organic liquids, and other debris, and return them to vacuum storage tank 16. These materials are vacuumed away at the same time as water is being sprayed under high pressure into the contaminated surface; this ensures that these materials do not escape from underneath the hood.

Vacuum is created on the vacuum storage tank by one or more vacuum systems 40 connected to tank 16 by suitable piping 42. A single system can be used if desired; two vacuum systems 40 provide backup and system operability in case of a single system failure. Preferably, one or more generators are provided (not shown) to power the equipment described above, although any other desired means for providing power can be used.

In use, at the spill site, if necessary a dam is constructed to prevent runoff. Larger sold debris is removed by being swept into piles and removed as is done in the prior art. The vacuum hood can be used to pick up spilled liquids and small solid debris by pulling the trailer over the accident site, lowering the vacuum hood 38 to the ground, and operating the vacuum system. Heated clean water is not used at this stage.

Next, the water based cleaner described above, or other suitable solvent for the spilled material, is sprayed over the spill site and allowed to set. The time needed to set is generally only a few minutes. Then, the trailer is pulled over the spill site with the vacuum system and hot water system operating, to spray hot, pulsating water under the hood and remove the water and spilled organic liquids and other materials. After the trailer has passed, the concrete surface is very clean, and retains it original look. NO residue is left behind, and the concrete is cleaned beneath its top surface. The trailer creates a clean swath as it is pulled, and several passes may be needed to cover the entire spill area. Generally, only one cleaning pass is required to effectively clean the spill site, but if desired or needed the process can be repeated.

Figure 2:
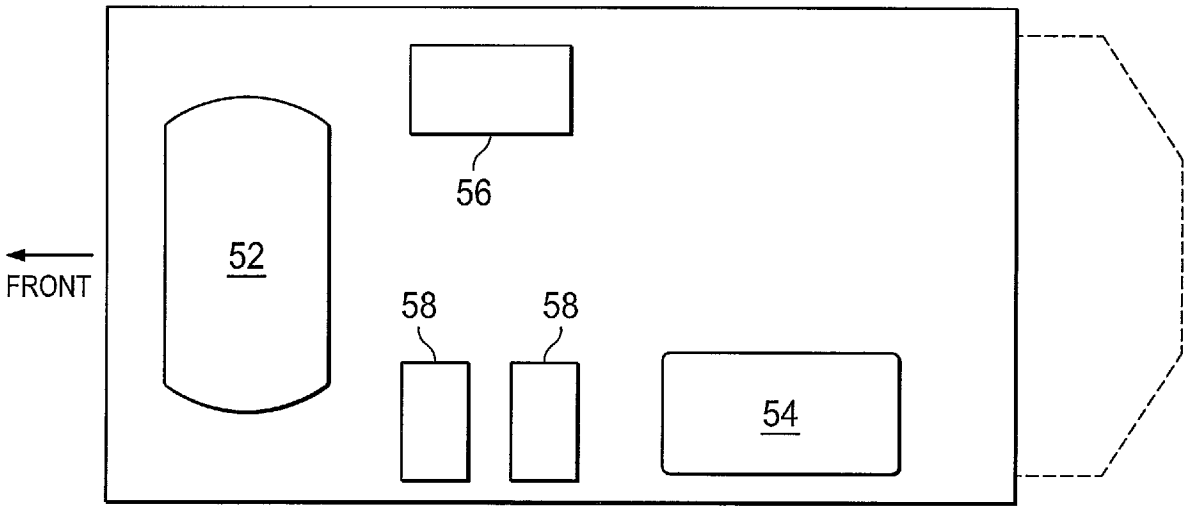
FIG. 2 is a plan diagram of a truck mounted version of the preferred embodiment of the present invention.

A similar system can be mounted on a truck if desired, rather than a trailer. FIG. 2 illustrates a plan layout of a truck bed that includes equipment similar to that described in connection with FIG. 1. A vacuum storage tank 52 and a clean water storage tank 54 are provided, and they are use in the same manner as previously described. A vacuum system 56 creates a vacuum as described above, and heater/compressor units 58 provide water heated to approximately 175 degrees F. under high pressure. If desired or needed, additional clean water storage can be provided next to storage tank 54. Valves and pipes similar to those shown in FIG. 1 are provided, but not shown in FIG. 2.

A vacuum hood 60 can be provided at the rear of the truck, and preferably lowered and hoisted out of the way as needed. If desired, hand held units (not shown) can be provided to perform the cleaning and vacuuming steps, but a larger, heavy duty system such as described above is preferred.

The system and method described herein is extremely useful for cleaning fuel and similar spills on concrete and other hard surfaces. Similar materials, such as paints and organic solvents can be cleaned in this manner. In all cases, the dirty water and other liquids are vacuumed up from the surface and temporarily stored in the holding tank, then transferred to other specified waste containers for transport and disposal.

While the invention has been described in terms of a preferred embodiment, it is not thus limited but is susceptible to various changes and modifications without departing from the spirit thereof.

What is claimed is:

1. A mobile system for using water to clean an organic spill from a contaminated hard surface, the mobile system comprising:

a mobile platform operably mounted on wheels for movement across the contaminated hard surface, the mobile platform having a width;

at least one clean water storage tank mounted on the mobile platform for storing the water;

a cleaning hood operably mounted on the mobile platform such that the cleaning hood may be positioned immediately above the contaminated hard surface, the cleaning hood extending across substantially the entire width of the mobile platform;

at least one heater compressor unit for heating water from the at least one clean water storage tank, compressing the water to at least 3,500 psi, and spraying the water through nozzles positioned within the cleaning hood, so that the water is directed onto the contaminated hard surface under the cleaning hood;

a waste water storage tank mounted on the mobile platform, and isolated from the at least one clean water storage tank, so that no water from the waste water storage tank contaminates the water in the at least one clean water storage tank;

a vacuum generator for generating a vacuum in the waste water storage tank; and wastewater lines extending between the waste water storage tank and the cleaning hood, so that contaminated water from the contaminated hard surface is drawn into the waste water storage tank, wherein the waste water storage tank is held in a constant state of negative pressure to prevent spillage.

2. The mobile system according to claim 1, wherein the at least one heater compressor unit heats the water to just below the boiling point of water.

* * * * *